US010689135B2

(12) United States Patent
Lazarus et al.

(10) Patent No.: US 10,689,135 B2
(45) Date of Patent: Jun. 23, 2020

(54) METHOD OF PACKAGING OF POLYSILICON

(71) Applicant: Wacker Chemie AG, Munich (DE)

(72) Inventors: Werner Lazarus, Mitterskirchen (DE); Franz Bergmann, Mehring (DE); Matthias Vietz, Mattighofen (AT)

(73) Assignee: WACKER CHEMIE AG, Munich (DE)

( * ) Notice: Subject to any disclaimer, the term of this patent is extended or adjusted under 35 U.S.C. 154(b) by 227 days.

(21) Appl. No.: 15/576,530

(22) PCT Filed: May 20, 2016

(86) PCT No.: PCT/EP2016/061406

§ 371 (c)(1),
(2) Date: Nov. 22, 2017

(87) PCT Pub. No.: WO2016/188893

PCT Pub. Date: Dec. 1, 2016

(65) Prior Publication Data

US 2018/0148198 A1 May 31, 2018

(30) Foreign Application Priority Data

May 26, 2015 (DE) ..... 10 2015 209 629

(51) Int. Cl.

| | |
|---|---|
| ***B65B 1/06*** | (2006.01) |
| ***B65B 1/32*** | (2006.01) |
| ***B65B 29/00*** | (2006.01) |
| ***B65B 25/00*** | (2006.01) |
| ***B65B 39/00*** | (2006.01) |
| ***B65B 43/54*** | (2006.01) |

(52) U.S. Cl.

CPC ..... *B65B 1/06* (2013.01); *B65B 1/32* (2013.01); *B65B 25/00* (2013.01); *B65B 29/00* (2013.01); *B65B 39/007* (2013.01); *B65B 43/54* (2013.01)

(58) Field of Classification Search

CPC ..... B65B 1/06; B65B 1/32; B65B 39/007; B65B 39/06; B65B 43/54; B65B 43/60; B65B 43/62

USPC ..... 53/428, 431, 469, 284.7; 134/150, 160; 141/270, 273, 284, 319, 364

See application file for complete search history.

(56) References Cited

U.S. PATENT DOCUMENTS 1,117,821 A * 11/1914 Erickson ..... B08B 3/006 134/160
1,909,670 A * 5/1933 Evans ..... B65B 39/06 141/284
3,137,327 A * 6/1964 Muench ..... B01F 9/02 141/364

(Continued)

FOREIGN PATENT DOCUMENTS

CN 101678905 A 3/2010
CN 102951314 A 3/2013

(Continued)

*Primary Examiner* — Stephen F. Gerrity
(74) *Attorney, Agent, or Firm* — Brooks Kushman P.C.

(57) ABSTRACT

Reduction of contamination and the proportion of fines fractions in the packaging of rod form polysilicon is achieved by directly filling a plastic bag with polysilicon from a cleaning bowl by a rotating motion which causes polysilicon chunks to slide into the bag.

12 Claims, 1 Drawing Sheet

(56) References Cited

U.S. PATENT DOCUMENTS

| | | | | |
|---|---|---|---|---|
| 5,723,160 | A * | 3/1998 | Nora et al. | B01D 46/38 23/313 FB |
| 5,855,232 | A * | 1/1999 | Oda et al. | B65B 1/32 141/364 |
| 6,309,467 | B1 | 10/2001 | Wochner et al. | |
| 7,013,620 | B2 | 3/2006 | Hoelzlwimmer et al. | |
| 10,377,636 | B2 * | 8/2019 | Miyao et al. | C30B 29/06 |
| 2002/0168880 | A1 * | 11/2002 | Hori | B08B 3/04 134/22.1 |
| 2006/0088970 | A1 | 4/2006 | Hesse et al. | |
| 2010/0154357 | A1 | 6/2010 | Wochner et al. | |
| 2010/0243103 | A1 | 9/2010 | Ono et al. | |
| 2012/0198793 | A1 | 8/2012 | Vietz et al. | |
| 2013/0042582 | A1 | 2/2013 | Vietz et al. | |
| 2013/0216466 | A1 * | 8/2013 | Traunspurger et al. | H01L 21/02046 134/20 |
| 2013/0309524 | A1 | 11/2013 | Vietz et al. | |
| 2014/0130455 | A1 | 5/2014 | Lazarus et al. | |

FOREIGN PATENT DOCUMENTS

| | | | |
|---|---|---|---|
| EP | 0905796 | A1 | 3/1999 |
| EP | 0905796 | B1 | 4/2002 |
| EP | 1645333 | A1 | 4/2006 |
| JP | H0594187 | U | 12/1993 |
| JP | 2012184037 | A2 | 9/2012 |
| JP | 2013039977 | A2 | 2/2013 |
| JP | 2013241330 | A2 | 12/2013 |

* cited by examiner

METHOD OF PACKAGING OF POLYSILICON

CROSS REFERENCE TO RELATED APPLICATIONS

This application is the U.S. National Phase of PCT Appln. No. PCT/EP2016/061406 filed May 20, 2016, which claims priority to German Application No. 10 2015 209 629.7 filed May 26, 2015, the disclosures of which are incorporated in their entirety by reference herein.

BACKGROUND OF THE INVENTION

1. Field of the Invention

The invention relates to the packaging of polysilicon.

2. Description of the Related Art

Polycrystalline silicon, or "polysilicon" for short, may be deposited in rod-form from chlorosilanes by means of the Siemens process. The rod-shaped polysilicon is then typically crushed into chunks, i.e. chunk polysilicon, ideally in a contamination-free manner. Such a method and a corresponding crusher are described in EP 1 645 333 A1.

Chunk polysilicon is a sharp-edged, non-free-flowing bulk material.

However, in the course of comminution the high-purity silicon is contaminated with foreign atoms. These are in particular metal carbide or diamond residues and metallic impurities.

For higher-value applications, for example for single-crystal pulling, chunk silicon is therefore usually cleaned prior to further processing and/or packaging. This is typically accomplished in one or more chemical wet cleaning steps. These involve using mixtures of different chemicals and/or acids to remove in particular adhering foreign atoms from the surface.

EP 0 905 796 B1 claims a method of producing silicon having a low metal concentration, characterized in that the silicon is subjected to a precleaning where in at least one stage it is washed with an oxidizing cleaning solution containing the compounds hydrofluoric acid (HF), hydrochloric acid (HCl) and hydrogen peroxide ($H_2O_2$), a main cleaning where in a further stage it is cleaned with a cleaning solution comprising nitric acid ($HNO_3$) and hydrofluoric acid (HF) and a hydrophilization where in a further stage it is washed with an oxidizing cleaning solution.

After the cleaning step the cleaned chunk polysilicon is typically packaged into plastic bags.

U.S. Pat. No. 7,013,620 B2 discloses an apparatus for fully automatic transport, weighing, portioning, filling and packaging of high-purity chunk polysilicon. The apparatus comprises a conveying channel for the chunk polysilicon, a weighing apparatus for the chunk polysilicon connected to a funnel, deflection plates made of silicon, a filling apparatus which forms a plastic bag from a high-purity plastic film (made of PE for example) and a welding apparatus for the plastic bag filled with chunk polysilicon.

Sheathing components of the apparatus with silicon or with a highly wear-resistant plastic is said to permit low-contamination packaging of the chunk polysilicon.

US 2010/0154357 A1 discloses an apparatus for packaging chunk polysilicon composed of a carousel filling and closing machine or a noncircular apparatus comprising a filling station and a closing station in which a PE bag is suspended on a gripper system and moved from station to station in a cyclical sequence, wherein the filling station comprises a freely suspended energy absorber made of a nonmetallic low-contamination material of construction which is introduced into the PE bag before the filling of the PE bag with polycrystalline silicon and is removed from the PE bag after the filling of the PE bag with polycrystalline silicon and the filled PE bag is conveyed onward into the closing station by means of the gripper system and is closed there.

According to US 2010/0154357 A1 the polysilicon is initially weighed, portioned into a process bowl and cleaned before it is introduced in these portioned units via a filling apparatus comprising a freely suspended flexible hose made of a nonmetallic low-contamination material of construction into a likewise freely suspended high-purity plastic bag and the plastic bag is subsequently closed. The bag is opened at the filling station of the apparatus. A conveying device lined with silicon or a low-contamination material of construction and connected to a movable flexible hose made of a nonmetallic material of construction, for example plastic, is used to fill the sharp-edged chunk polysilicon into the opened PE bag through this hose. The conveying device is, for example, a conveying channel or a chute, preferably a chute.

US 2012/0198793 A1 discloses a method of metering and packaging polysilicon chunks, wherein a product stream of polysilicon chunks is transported via a conveying channel, separated into coarse and fine chunks by means of at least one screen, weighed and metered to a target weight by means of a metering balance and discharged and transported via a discharging channel to a packaging unit where the polysilicon chunks are filled into a first plastic bag and the bag is closed, wherein the plastic bag comprising polysilicon chunks is packaged into a further plastic bag shaped by means of a shaper and subsequently welded shut, wherein the at least one screen and the metering balance at least partially comprise a hard metal on their surfaces and the shaper for shaping the plastic bag has an abrasion-resistant coating.

US 2013/0042582 A1 discloses a method of packaging polycrystalline silicon where polycrystalline silicon is filled into a plastic bag by means of a filling apparatus, characterized in that a reservoir container has an opening through which the silicon is filled, wherein after the filling of the reservoir container with silicon the plastic bag is pulled over the reservoir container and the reservoir container is subsequently rotated so that the silicon slides out of the reservoir container into the plastic bag.

It has been found that during the packaging of chunks of a certain size class, for example in the case of chunk sizes of 20 to 60 mm, undesired smaller silicon particles or chunks are also formed. For such chunk sizes the proportion of such undesired particles is 17,000-23,000 ppmw.

Hereinbelow, all chunks or particles of silicon that are of a size such that they may be removed via a mesh screen having square mesh apertures of 8 mm×8 mm are referred to as a "fines fraction." The fines fraction is undesirable to the customer since it has a negative impact on customer processes. If the fines fraction needs to be removed by the customer, for example by screening, this requires extra effort.

In addition to automatic packaging of polycrystalline silicon such as that according to U.S. Pat. No. 7,013,620 B2, manual packaging of the polycrystalline silicon into plastic bags is also possible.

US 2012/0198793 A1 reports that a labor-intensive manual packaging of cleaned polysilicon chunks in a class 100 clean room is necessary to achieve the required high weighing accuracy of less than +/−1% for chunk polysilicon for the semiconductor industry. This comprises taking, with high-purity gloves, for example high-purity textile, PU or PE gloves, cleaned polysilicon chunks no longer having any metallic impurities on their surface from a process bowl in which the cleaning is effected and introducing them into a PE double bag.

US 2014/0130455 A1 discloses a method of packaging polycrystalline silicon present in the form of chunks which comprises the steps of providing polycrystalline silicon in a metering system;

filling polycrystalline silicon from the metering system, via which fines fraction is removed by way of screens, into a plastic bag disposed below the metering system;

wherein during filling the weight of the plastic bag with the filled polycrystalline silicon is determined and after achievement of a target weight the filling operation is stopped;

wherein during the entire filling operation a fall height for the polycrystalline silicon from the metering system into the plastic bag of less than 450 mm is maintained by means of at least one clamping apparatus.

The fall height of the polycrystalline silicon from the conveying channel of the metering system into the plastic bag needs to be less than 450 mm, preferably not more than 300 mm. This makes it possible to reduce the amount of fines fraction.

Manual packaging makes it possible to reduce the amount of fines fraction even more markedly, from 17,000 ppmw to as little as 1400 ppmw for the chunk size 20-60 mm. However, manual packaging entails a great deal of effort and increased labor costs. It would moreover be desirable to reduce the amount of fines fraction even further than is achievable through manual packaging.

The invention accordingly has for its object the automatic packaging of polycrystalline silicon and the reduction of the amount of fines fraction thereby formed to an extremely low level. The invention also has for its object the provision of an apparatus suitable for this purpose. The object to be achieved by the invention arose from the problems described.

SUMMARY OF THE INVENTION

The object(s) of the invention are achieved by a method of packaging polysilicon comprising providing polysilicon in the form of chunks of comminuted polysilicon rods produced by deposition of polysilicon in rod-form in a reactor, cleaning the polysilicon, packaging the polysilicon, wherein the polysilicon is situated in a process bowl during cleaning and wherein packaging the polysilicon from the process bowl into a plastic bag comprises rotating a filling unit which has the process bowl and the plastic bag secured to it, so that the polysilicon slides from the process bowl into the plastic bag.

DETAILED DESCRIPTION OF THE PREFERRED EMBODIMENTS

Figure 1D:
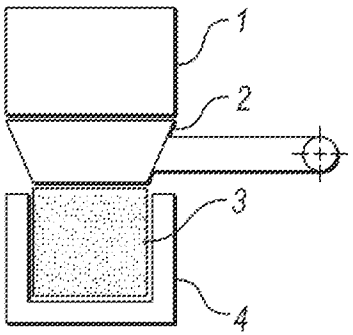
FIGS. 1A-1D illustrate in schematic form, the state of the packaging plant according to one embodiment of the invention at various points in time.

The plastic bag is preferably a prefabricated double bag. Thus, in a departure from the prior art, the polysilicon is not packaged in a first plastic bag that is subsequently placed into a second plastic bag. The polysilicon is preferably filled directly into a double bag.

To this end the double bag is secured in the packaging plant, preferably by being clamped.

In one embodiment the plastic bag is preshaped in a shaper and then positively locked into the packaging plant with the aid of the shaper. In the simplest case the shaper is a mounting bowl in which the shaped plastic bag is situated. The shaper is mechanically clamped to the packaging plant. The shaper ensures that the plastic bag retains its shape during the rotation of the plant. It is ensured that no polysilicon chunk can fall out of the packaging plant during the filling operation.

The polysilicon to be cleaned and packaged is initially situated in a process bowl. The polysilicon is cleaned while situated in the process bowl as described in US 2010/0154357 A1. The cleaning of the polysilicon in the process bowl may be effected, for example, as described in EP 0 905 796 B1.

In a departure from the prior art the filling of the plastic bag with polysilicon is effected not via a conveying device, for example a conveying channel or a chute, but directly from the process bowl. This has the advantage that the polysilicon in the process bowl does not have to overcome a direct fall height. Additionally, the emptying of the process bowl into the bag or double bag is effected via a rotation of the process bowl and the bag/double bag. Owing to the rotation of the process bowl and the double bag the polysilicon is set into a rolling/sliding state and thus slides into the held-open double bag. As a result, the smallest possible amount of fines fraction is formed.

In one embodiment every emptied process bowl is checked for complete emptying with a weighing and/or camera system and released.

The packaging plant comprises at least one filling unit. In the simplest case this is a type of funnel.

The polysilicon slides from the process bowl into the plastic bag via the filling unit.

In one embodiment the filling unit is made of silicon.

However, other materials of construction which are low-contamination with respect to silicon may also be employed.

One opening of the filling unit has a process bowl containing polysilicon secured to it.

A shaper having a PE double bag situated therein is clamped in place on the opposite side.

In one embodiment the process bowl is made of a chemically stable material.

The shaper is advantageously made of a shape-stable material.

Depending on throughput requirements the receiving of the bag and the process bowl may be effected in manual or automatic fashion.

In one embodiment the packaging plant comprises a main frame and a rotatable frame.

The rotatable frame has the filling unit secured to it. Drive is transmitted to a drive shaft which sets the rotatable frame into rotation. Meanwhile, the emptying of the process bowl and thus the filling of the bag is effected.

The speed of the rotation is adjustable as a function of the tipping angle according to the chunk size. In the context of the invention the tipping angle is the angle above which the polysilicon begins to slide out of the process bowl and into the bag via the filling unit.

In one embodiment—as soon as the tipping angle is reached—the rotational speed is reduced to an extent such that the entire filling of the bag is effected in the form of a sliding motion of the polysilicon. This ensures a particularly gentle packaging.

The plant may be implemented with one or more filling units. In one embodiment up to 10 rotatable filling units and the same number of process bowls and plastic bags are present. In one embodiment the plant comprises two filling units.

It is preferable when the takeoff of the filled bags and also the mounting and clamping of the new empty bags is situated opposite the feed of the process bowls.

The bag mounting and bag takeoff operations may be automated.

One embodiment includes a shaper receiver which serves to secure a shaper comprising a plastic bag.

In one embodiment the plastic bag is pulled, with its opening, over one end of the filling unit. The process bowl comprising the polysilicon to be packaged is secured to the other end of the filling unit.

In one embodiment the main frame of the plant comprises feet and lateral securing brackets.

The feet and the shaper receiver may each have a respective cover.

These covers and the lateral securing brackets may be fabricated from a material which is low-contamination with respect to silicon. They preferably comprise linings made of plastics (for example PU) or made of silicon.

In one embodiment the rotating motion of the plant is accomplished via a geared motor which drives a drive shaft and is connected to toothed belt pulleys via a toothed belt.

The features cited in connection with the above described embodiments of the method according to the invention may be realized either separately or in combination as embodiments of the invention. Said features may further describe advantageous implementations eligible for protection in their own right.

LIST OF REFERENCE NUMERALS EMPLOYED

1 process bowl
2 filling unit
3 plastic bag
4 shaper

Figure 1C:
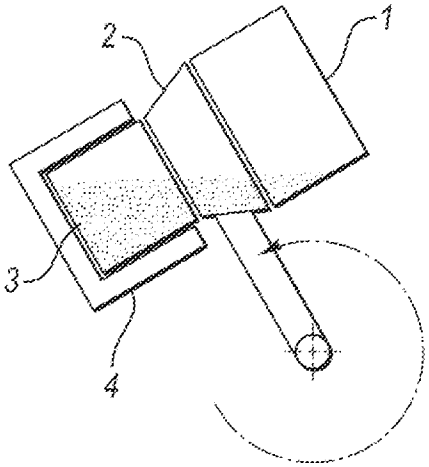
Figure 1B:
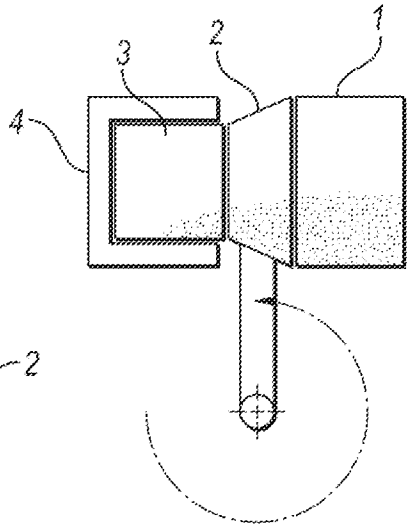
Figure 1A:
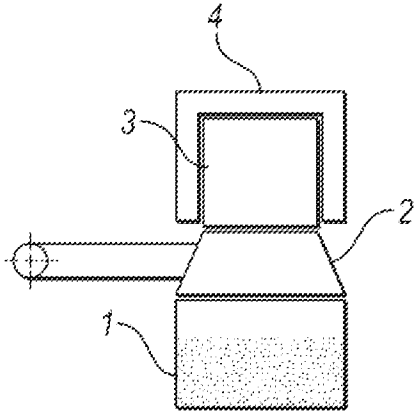

FIGS. 1A-1D show the progress of the packaging operation over time. The figures show the process bowl 1 in which, in starting state t1 (FIG. 1A), the polysilicon is situated, the filling unit 2 to which the process bowl 1 and the plastic bag and 3 are secured.

The polysilicon from process bowl 1 is introduced into the plastic bag 3 via the filling unit 2.

The plastic bag 3 is situated in the shaper 4.

The shaper 4 serves as a shaping body for the plastic bag 3.

The shaper 4 is also clamped to the filling unit 2 or to a receiving means for the shaper provided for this purpose, i.e. also ensures that the plastic bag is secured.

The FIGURE also depicts the axis of rotation.

At timepoint t2 (FIG. 1B) the polysilicon begins to slide from the process bowl 1 into the plastic bag 3 via the filling unit 2.

At this timepoint the rotational speed of the plant should be reduced to ensure a sliding motion of the polysilicon during the entire filling operation (for example time at t3 (FIG. 1C)).

At timepoint t4 (FIG. 1D) the entirety of the polysilicon is situated in plastic bag 3.

The rotation of the plant may then be stopped.

The filled plastic bag 3 is taken off and, for example, welded shut, packaged in a cardboard box and dispatched.

Comparative Example

The polysilicon is placed into the process bowl for cleaning.

The weight placed in the process bowls is, for example, 5 kg plus a small supplement for the material removed by etching which depends on the size of the chunks.

After performance of the cleaning process the target weight in the process bowl is 5 kg+−50 g.

The process bowls are then transported to the packaging.

Here, the bowls are received by a robot by means of a gripping system and emptied onto a packaging chute.

Situated at the end of the packaging chute is a double bag mounted in a shaper.

The double bag is filled by erecting the chute containing the polysilicon so that the polysilicon slides into the bags.

The emptying of the process bowls onto the chute and the sliding motion to the bag causes postcomminution of the polysilicon. This generates a fines fraction.

Example

The process bowls are clamped to the filling unit of a packaging plant according to the invention.

At the other end of the filling unit is a shaper which has a double bag mounted in it.

The double bag is filled by setting the process bowl and the double bag into a rotating motion, thus causing the polysilicon to slide into the bag.

The fines fraction formed was reduced by more than 50% compared to the chute packaging (comparative example).

The description hereinabove of illustrative embodiments is to be understood as being exemplary. The disclosure made thereby enables a person skilled in the art to understand the present invention and the advantages associated therewith and also encompasses alterations and modifications to the described structures and methods obvious to a person skilled in the art. All such alterations and modifications and also equivalents shall therefore be covered by the scope of protection of the claims.

The invention claimed is:

1. A method for packaging polysilicon in the form of chunks of comminuted polysilicon rods into a plastic bag, the method comprising:

a) cleaning the polysilicon in a process bowl to provide cleaned polysilicon;

b) securing the process bowl containing cleaned polysilicon onto a filling unit which is rotatable about an axis;

c) mounting a plastic bag to the filling unit; and d) rotating the filling unit about the axis such that the cleaned polysilicon slides from the process bowl into the plastic bag.

2. The method of claim 1, further comprising a bag shaper secured to the filling unit.

3. The method of claim 2, wherein the filling unit is made of silicon.

4. The method of claim 2, wherein following step d), the process bowl is checked for complete emptying by the use of at least one of a weighing system or a camera system.

5. The method of claim 2, further comprising:

reducing a speed of rotation of the filling unit about the axis of rotation after a timepoint at which the polysilicon begins to slide from the process bowl to the plastic bag via the filling unit.

6. The method of claim 1, wherein the filling unit is made of silicon.

7. The method of claim 6, wherein following step d), the process bowl is checked for complete emptying by the use of at least one of a weighing system or a camera system.

8. The method of claim 6, further comprising:

reducing a speed of rotation of the filling unit about the axis of rotation after a timepoint at which the polysilicon begins to slide from the process bowl to the plastic bag via the filling unit.

9. The method of claim 1, wherein following step d), the process bowl is checked for complete emptying by the use of at least one of a weighing system or a camera system.

10. The method of claim 9, further comprising:

reducing a speed of rotation of the filling unit about the axis of rotation after a timepoint at which the polysilicon begins to slide from the process bowl to the plastic bag via the filling unit.

11. The method of claim 1, further comprising:

reducing a speed of rotation of the filling unit about the axis of rotation after a timepoint at which the polysilicon begins to slide from the process bowl to the plastic bag via the filling unit.

12. The method of claim 1, wherein the plastic bag is a prefabricated double bag.

* * * * *